United States Patent [19]

Komplin

[11] Patent Number: 4,616,945

[45] Date of Patent: Oct. 14, 1986

[54] CORRECTION FEED MECHANISM IN A CORRECTION TAPE CARTRIDGE

[75] Inventor: Steven R. Komplin, Lexington, Ky.

[73] Assignee: International Business Machines Corporation, Armonk, N.Y.

[21] Appl. No.: 696,689

[22] Filed: Jan. 31, 1985

[51] Int. Cl.[4] ..... B41J 29/36; B41J 33/18

[52] U.S. Cl. ..... 400/697.1; 400/208; 400/212; 400/229; 400/236.1

[58] Field of Search ..... 400/208, 211, 212, 213, 400/213.1, 214, 215, 215.3, 216, 225, 229, 235, 236, 236.1, 697, 697.1, 196.1, 223, 235.1, 236.2

[56] References Cited

U.S. PATENT DOCUMENTS

| | | | |
|---|---|---|---|
| 3,863,749 | 2/1975 | Perry et al. | 400/235.1 |
| 3,871,507 | 3/1975 | Perry et al. | 400/208 |
| 4,302,118 | 11/1981 | Schaefer | 400/208 |
| 4,385,848 | 5/1983 | Camosso | 400/697.1 |
| 4,411,542 | 10/1983 | Wenderoth et al. | 400/697.1 |

FOREIGN PATENT DOCUMENTS

| | | | |
|---|---|---|---|
| 8279 | 2/1980 | European Pat. Off. | 400/208 |
| 58-191183 | 11/1983 | Japan | 400/697.1 |

OTHER PUBLICATIONS

A. H. Caudill et al, "Ribbon Feed Mechanism", *IBM Technical Disclosure Bulletin,* vol. 11, No. 12, pp. 1754–1755, May 1969.

*Primary Examiner*—Edgar S. Burr
*Assistant Examiner*—David A. Wiecking
*Attorney, Agent, or Firm*—Laurence R. Letson

[57] ABSTRACT

A cartridge 12 for correction tape 22 is disclosed which utilizes a cam follower 40 operated pawl 50/ratchet 52 for feeding of the tape 22, where the pawl 50 is operated as a result of the movement of a cam follower 40 against a cam 40 on the support frame 10. As the cartridge 12 oscillates, the pawl 50 is displaced to increment the ratchet 52 to effect feed.

5 Claims, 4 Drawing Figures

CORRECTION FEED MECHANISM IN A CORRECTION TAPE CARTRIDGE

This invention relates to the feeding of correction tape and more particularly to the mechanism for incrementing the correction tape in a correction cartridge on a typewriter.

RELATED INVENTION

U.S. patent application Ser. No. 696,990, filed Jan. 31, 1985, on even date with the filing of this application, entitled "Single Stepping Motor Ribbon and Correction Feed and Lift System," by Steven R. Komplin and assigned to International Business Machines Corporation, Armonk, N.Y., discloses and claims the ribbon feed and correction tape feed mechanism upon which the cartridge disclosed herein operates.

BACKGROUND OF THE INVENTION

The feeding of a correction tape requires a separate feed device from that which feeds the printing ribbon on a typewriter or printer. This duplication of drive hardware is not only expensive, but provides additional potential for mechanism malfunction, thereby creating additional reliability problems.

In typewriters which utilize an oscillating cartridge system, the drives for feeding the ribbon and the correction tapes must, of necessity, either be mounted such that they move with the cartridges as the cartridge oscillates or alternatively must provide a flexible connection to the drive of the cartridge from the drive mechanism mounted on a fixed hardware mounting in the typewriter.

U.S. Pat. No. 4,302,118 to John O. Schaefer and assigned to International Business Machines Corporation discloses a ribbon and correction feed mechanism which is mounted on an oscillating ribbon feed plate which oscillates with the cartridge, thus functioning as if the cartridge and the ribbon mechanism were spacially fixed.

U.S. Pat. Nos. 3,863,749 and 3,871,507, both patents to Donald S. Perry et al, disclose a mechanism for drivingly engaging the ratchet teeth of a drive mechanism from the exterior of the cartridge while at the same time providing a lifting of oscillating mechanical input to the cartridge to effect ribbon lift. The device disclosed in these two patents is a multiple link lever chain driven by a cam to cause the feed of the ribbon. The patent does not disclose any technique for feeding of correction tape inasmuch as only one feed mechanism is disclosed.

As may be seen from the Perry et al patents, the oscillating cartridges complicate feed mechanisms since the feed mechanism must be able to feed and also accommodate the oscillatory motion of the cartridge. The same considerations are borne out by the feed mechanism disclosed by Schaefer in U.S. Pat. No. 4,302,118, referred to above.

It is an object of the invention to eliminate complex mechanical drives necessary to effect the incrementing of correction tape for an oscillating ribbon feed cartridge system.

It is a further object of the invention to simplify the correction tape feed in a ribbon feed system having both a ribbon and correction tape contained in oscillating ribbon cartridge and correction tape cartridge.

SUMMARY OF THE INVENTION

The shortcomings of the prior art are overcome and the objects of the invention accomplished by the incorporation of a feed pawl into a correction ribbon cartridge for engagement with a ratchet wheel which is drivingly connected to the takeup spool of the cartridge. The feed pawl derives its motion for retraction and extension to feed, from the oscillation of the cartridge with respect to a fixed support and camming surface. This eliminates the separate powered feed mechanism from the overall ribbon feed/correction tape mechanism for the typewriter.

The feed pawl is mounted interiorly to the cartridge with an extension projecting from the cartridge confines thereby making the extension capable of interacting with a camming member as a cam follower. The feed pawl, when extended, will interact with the takeup spool and pull the correction tape from the supply spool across the print zone.

The cam surface fixed on the frame of the carrier or the ribbon feed mechanism provides the pawl the input through the extension or cam follower. The cam surface or channel is configured such that the cam follower of the feed pawl rides in a portion of the channel configured so that the cam follower is not significantly displaced relative to the cartridge during the portion of the oscillations of the cartridge assembly needed to raise the printing ribbon to the print point. When the cartridge assembly is oscillated to the extent necessary to present correction tape at the print point, the cam follower is moved through a portion of the cam channel configured to cause the pawl to be retracted relative to the teeth of the ratchet and prepare the pawl for a feeding movement upon the subsequent lowering of the correction tape. As the cartridge is oscillated downward, the cam profile forces the cam follower to displace and during such displacement the cam follower moves the ratchet to feed the tape.

The oscillation of the printing ribbon cartridge and the correction tape cartridge to the necessary positions for printing will not effect tape feed and conserves the correction tape. Cartridge oscillation to the elevated position necessary for correction will cause pawl retraction and conditions the mechanism for tape feed only during those cycles where a correction is to be accomplished.

DETAILED DESCRIPTION OF THE INVENTION

Figure 1:
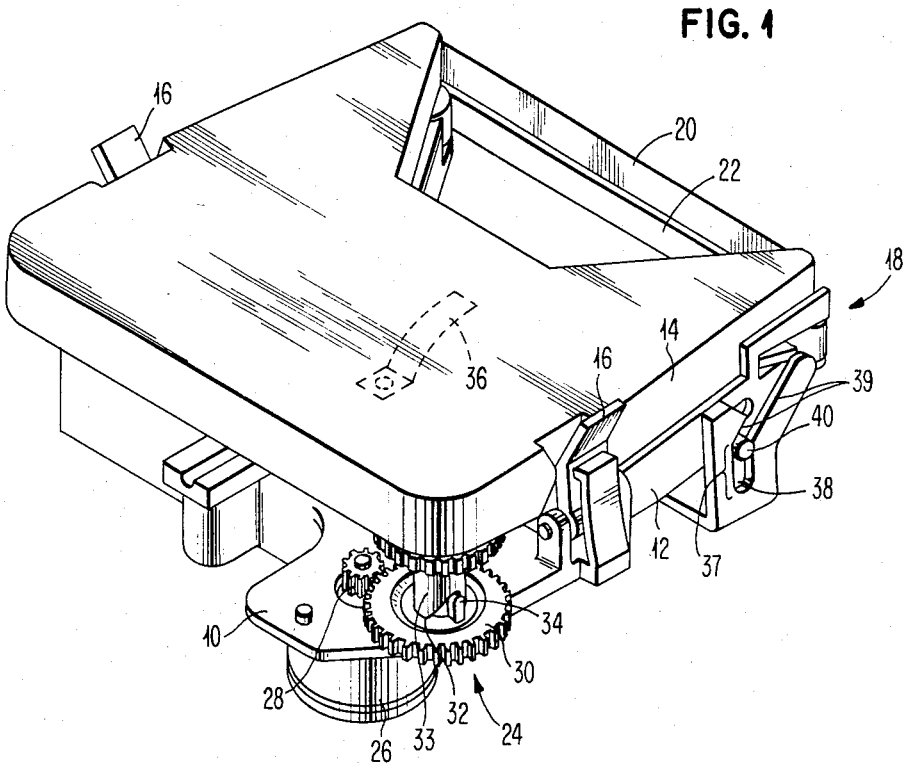
FIG. 1 illustrates the ribbon feed mechanism together with a correction tape cartridge and a ribbon cartridge mounted on the feed mechanism.
Figure 2:
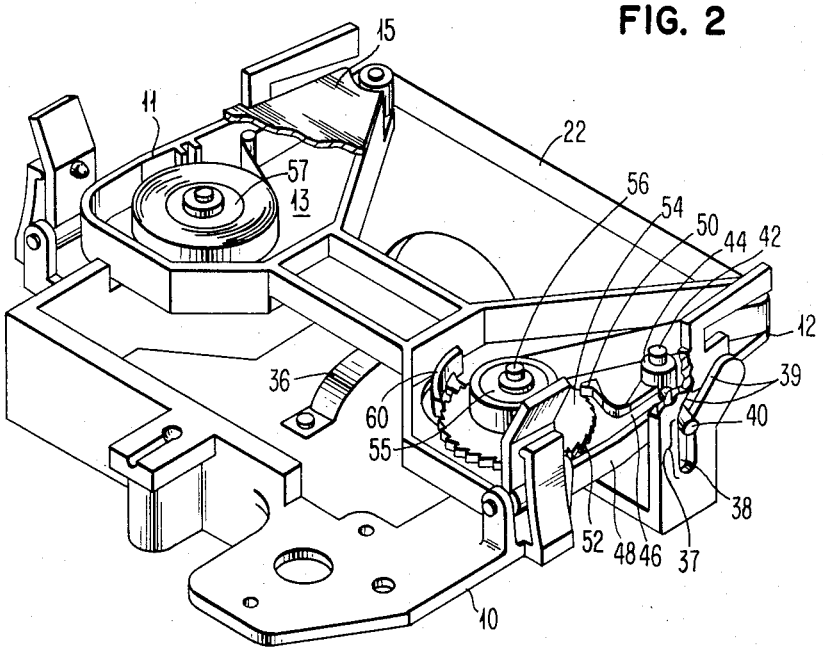
FIG. 2 illustrates the ribbon feed plate with the correction tape cartridge positioned as it would be when the ribbon cartridge is mounted on the ribbon feed plate, with the top of the correction tape cartridge removed.

Referring to FIG. 1, a ribbon feed plate 10 supports a correction tape cartridge 12 and ribbon cartridge 14 pivotally. The support is provided by support members 16 which engage the ribbon cartridge 14 and pivot the ribbon cartridge 14 with respect to the support members 16. Referring to FIG. 2, correction tape cartridge 12 has at least walls 11 and floor 13 and a top cover 15 partially shown for visibility, to define a housing or chamber.

Correction tape cartridge 12 is physically attached and latched to ribbon cartridge 14 and becomes a part of the cartridge assembly 18. The attachment of tape cartridge 12 to ribbon cartridge 14 may be as disclosed in U.S. Pat. No. 4,239,107 to R. G. Boyatt, Jr. et al and commonly assigned herewith. The raising and lowering of the ribbon 20 and the correction tape 22 is accomplished by means of the ribbon lift/feed mechanism 24 which comprises a drive motor 26 having a drive gear 28 and a drive gear 30. Driven gear 30 has formed on one face thereof a raised cam follower 34 which, when rotated, will act against cylindrical face cam 33 to exert an upward force against the rear of the ribbon cartridge 14. This will cause ribbon cartridge 14 to oscillate around pivot points of the cartridge to lower the ribbon 20 with respect to the print line of a typewriter (not shown) to permit visibility of the writing line. On a printer such as might be used with a small office computer, visibility is not critical and the system may not provide for this last described cartridge positioning.

In order to raise the ribbon 20 or correction tape 22 to the elevated position necessary to accomplish their function at the writing line, the cam follower 34 on gear 30 is rotated such that a lower rise of the cam profile 32 is engaged with the cam follower 34 thereby allowing the rear end of the cartridge 14 to be lowered under the influence of spring 36 which is mounted to the ribbon feed plate 10.

In order to control the feed of the correction tape 22, cam surfaces 39 are attached to or formed as a part of ribbon feed plate 10 and remain fixed relative thereto. Cam surfaces 39 form a channel 38. Channel 38 confines cam follower 40 and controls its movement relative to the correction tape cartridge 12. Channel 38 is formed with a generally vertical portion 37 which approximates the unimpeded path of movement of follower 40 during the oscillation of cartridge assembly 18 which raises the ribbon 20 to the printing position.

Thus as the cartridge assembly 18 oscillates through a range of movement necessary for normal printing operations, cam follower 40 remains in portion 37 and therefore will not be displaced relative to cartridge 12 by any significant amount. However, when the oscillation of the cartridge assembly 18 is extended further to effect the positioning of correction tape 22 at the print line of the typewriter, the cam follower 40 will ride into the upper forward directed regions of channel 38, and will be forced forward as the cartridge assembly 18 is oscillated to raise the ribbon 22 and tape 22.

After the correction operation has occurred and the correction tape 22 is no longer needed at the print line, the ribbon feed/lift mechanism 24 is operated in reverse to lower the ribbon 20 and tape 22 from the print line. As lowering occurs, the cartridge assembly 18 oscillates and lowers the front portion of the cartridge assembly 18 together with the cam follower 40. As cam follower 40 is forced downward, it will engage the lower camming surface 39 of channel 38 causing the cam follower to be moved rearward with respect to cartridge 12.

Figure 3:
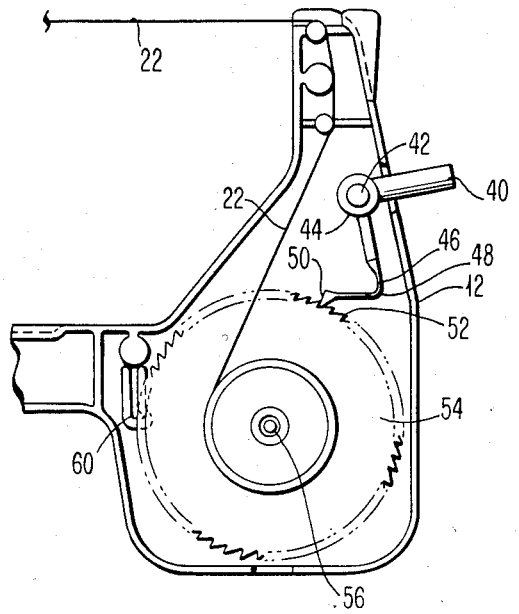
FIG. 3 illustrates a preferred embodiment of the ratchet and pawl drive arrangement together with the cam follower extending outwardly from the confines of the correction tape cartridge.

Referring to FIGS. 2 and 3, as the cam follower 40 is moved rearward, it will oscillate about the axis of pin 42. Cam follower 40 is a portion or extension of a pawl member 44 having a sleeve which may be fitted over pin 42. Extending from the sleeve to pawl 44 is a pawl arm 46. Pawl arm 46 is fashioned of a flexible material such as a resilient plastic and is capable of flexing primarily at the bend 48 in the arm 46 and is relatively rigid in compression. Pawl tip 50 is fashioned to engage the teeth 52 of ratchet 54.

As cartridge 12 is oscillated downward at the front edge to lower the correction tape 22, cam follower 40 will ride against one of the cam surfaces 39 forming channel 38. As the cam follower rides within channel 38, it will be forced rearward with respect to cartridge 12 and thus move pawl tip 50 into forcible driving engagement with one of the teeth 52 to cause the ratchet 54 to rotate about its axis.

The rotating of the ratchet 54 rotates the takeup spool 55 to wind the tape 22 thereon. As tape 22 is wound onto the takeup spool 55, the tape is unspooled from supply spool 57 and directed outside the cartridge to form a span across the cartridge 12 for presentation to the print point.

During a subsequent raising of the cartridge 12 to present the correction tape 22 at the print line, channel 38 will displace cam follower 40 in a forward direction, thus withdrawing the pawl tip 50 from the tooth 52 with which it was engaged and retracting it scu that it may re-engage another tooth 52 for a subsequent driving operation.

To prevent the unwinding of the correction tape 22 on takeup spool 55 during this phase of the operation, backcheck 60 is provided. Backcheck 60 is a pawl which yieldably engages teeth 52 of ratchet 54 preventing the reverse rotation of ratchet 54.

Figure 4:
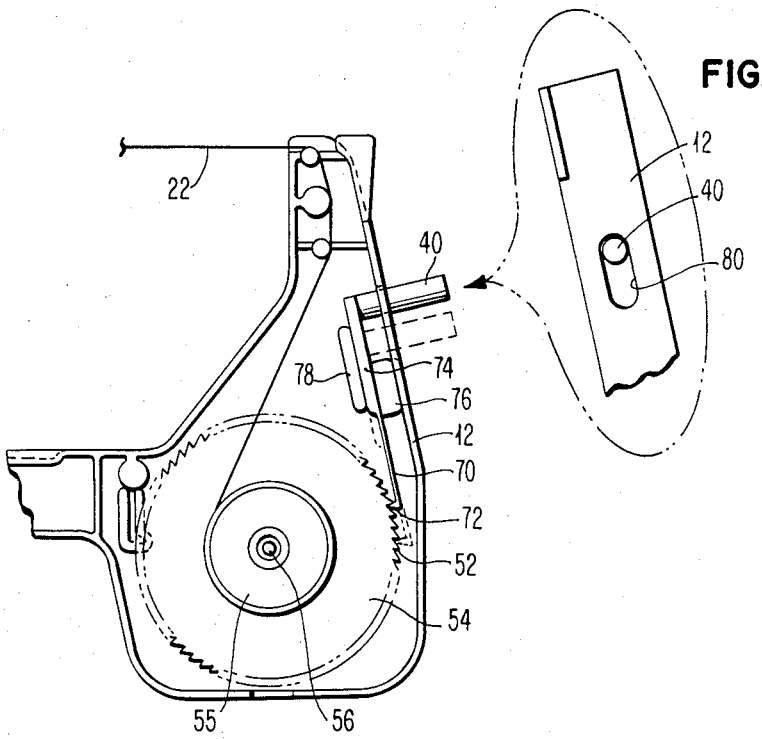
FIG. 4 is an alternative pawl and cam follower design to the one illustrated in FIG. 3.

FIG. 4 illustrates an alternative structure of a pawl 70 which is driven by the cam follower 40. Pawl 70 is engaged, by pawl tip 72, with ratchet teeth 52 on ratchet wheel 54. Pawl 70 is an extension of a slide member 74 which, in turn, is rigidly attached to cam follower 40. Slide member 74 is constrained against lateral movement by constraining walls 76 and 78 which are formed as a part of the structure of cartridge 12. Follower 40 exits cartridge 12 at an oblong slot 80, the upper and lower sides of which constrain follower 40 against vertical movement.

Thus, the slide member 74 is capable of reciprocating along its axis between constraining walls 76 and 78 to cause the reciprocal movement of pawl 70 and pawl tip 72.

In the case of the structure illustrated in FIG. 4, the driving portion of the operation would be accomplished as the cartridge is raised to present correction feed tape 22 to the point line and tip 72 of pawl 70 is extended for a subsequent feed cycle upon the lowering of the cartridge 12 and the correction tape 22.

If this sequence of operations proves to be undesirable as requiring a substantially stronger spring 36 and the commensurate loads on the ribbon feed/lift assembly 24, it would be possible, by merely reversing the form of the channel 38 to reverse the appropriate drive by reversing the directions of motion of cam follower 40.

I claim:

1. A tape cartridge for a typewriter using a print ribbon cartridge and including means for mounting the tape cartridge with said ribbon cartridge, said typewriter including a means for carrying a ribbon feed means and ribbon and tape cartridges thereon, including means for pivoting said ribbon cartridge and said tape cartridge to present ribbon and tape at a point for printing, said tape cartridge comprising in combination:

means defining an upper and lower surface spaced apart to define a chamber therebetween to embrace a supply spool and takeup spool and tape between said upper and lower surfaces; a tape supply and a tape takeup spool in said chamber; means for permitting said tape to leave said tape cartridge immediate said supply and said takeup spools for presenting said tape to a print point for utilization; tape drive means coupled to said tape and associated with said takeup spool to effect tape movement between said supply and said takeup spools; and cam follower means projecting outwardly from said chamber and from said correction tape drive means for engagement with a cam on said means for carrying so that upon pivoting of said correction cartridge from at least the level of presentation of said tape to said print point to a lower position, said cam follower means follows said cam to effect tape feed.

2. A correction ribbon cartridge of claim 1 wherein said cam follower drives a pawl to effect feed of said tape.

3. A correction ribbon cartridge of claim 2 wherein said drive means comprises a ratchet drivingly associated with said takeup spool and engaged in a driving fashion by said pawl.

4. A correction ribbon cartridge of claim 2 wherein said pawl is pivotally mounted within said cartridge.

5. A correction ribbon cartridge of claim 2 wherein said pawl is slideably reciprocatingly mounted within said cartridge.

* * * * *